US006085722A

United States Patent [19]

Zimmermann

[11] Patent Number: 6,085,722

[45] Date of Patent: Jul. 11, 2000

[54] EXHAUST RESTRICTOR WITH GEAR MOTOR ACTUATOR AND METHOD OF CONTROLLING SAME

[75] Inventor: Daniel E. Zimmermann, Peoria, Ill.

[73] Assignee: Caterpillar Inc., Peoria, Ill.

[21] Appl. No.: 08/769,259

[22] Filed: Dec. 18, 1996

[51] Int. Cl.[7] ..... F02D 9/06

[52] U.S. Cl. ..... 123/323

[58] Field of Search ..... 123/323; 137/513.3, 137/522, 527

[56] References Cited

U.S. PATENT DOCUMENTS

| | | | |
|---|---|---|---|
| 4,787,044 | 11/1988 | Nagata et al. | 701/110 |
| 5,096,156 | 3/1992 | Wylie et al. | 251/77 |
| 5,231,896 | 8/1993 | Kota | 477/118 |
| 5,394,901 | 3/1995 | Thompson et al. | 137/513.3 |
| 5,676,110 | 10/1997 | Meneely | 123/323 |

FOREIGN PATENT DOCUMENTS

| | | | |
|---|---|---|---|
| 92/08887 | 5/1992 | WIPO | F02D 9/06 |

*Primary Examiner*—Willis R. Wolfe
*Assistant Examiner*—Hieu T. Vo
*Attorney, Agent, or Firm*—Mario J. Donato, Jr.; Larry G. Cain

[57] ABSTRACT

An apparatus and method of restricting flow of exhaust gas in an exhaust gas duct of a machine having an internal combustion engine is disclosed. The apparatus includes a closure member pivotably mounted relative to the exhaust gas duct within the exhaust gas duct interior. The closure member is pivotable between a first position wherein the exhaust gas duct is substantially unblocked by the closure member and a second position wherein the exhaust gas duct is substantially blocked by the closure member. An actuator is operatively connected to the closure member, moving the closure member between the first and second positions. A machine speed sensor and a throttle position sensor are provided, as is a manually operable switch. An electronic controller is connected to the machine speed sensor, the throttle position sensor, the manually operable switch, and the actuator, wherein the electronic controller operates the actuator in response to a sensed value of the machine speed sensor, the throttle position sensor, and the state of the manually operable switch.

18 Claims, 5 Drawing Sheets

EXHAUST RESTRICTOR WITH GEAR MOTOR ACTUATOR AND METHOD OF CONTROLLING SAME

TECHNICAL FIELD

The present invention relates generally to an exhaust restricting valve to be incorporated in the exhaust system of an internal combustion engine, and more particularly, to an exhaust restricting valve having direct electric actuation.

BACKGROUND ART

Devices known as exhaust brakes can be fitted into a vehicle's exhaust system and which, by generating a back pressure, can assist the vehicle in braking. Similar devices termed warm-up valves, can also assist in cab heating and in reducing the emission of unburned hydrocarbons by reducing the time for the engine to reach normal operating temperature. Unlike most large trucks, school buses and some smaller trucks do not have air compressors onboard since they are not equipped with air brakes. Therefore, it is desirable to have direct electric actuation of the exhaust valve.

Motor driven valves, per se, are known in the prior art. Conventional systems of this type, however, have a number of deficiencies. Prior art arrangements commonly employ a direct interconnection between the output shaft of the motor and the exhaust valve damper blade. Energization of the motor causes rotation of the output shaft and corresponding movement of the damper blade to a desired position (usually a closed position) relative to the exhaust system with which the damper blade is operatively associated. Typically, the motor remains energized to hold the damper blade against one or more stops within the exhaust system which properly position the damper blade relative thereto. When the motor is de-energized, the prior art approaches often employ a spring in operative association with the damper blade to return the damper blade to its "normal" (usually open) position relative to the exhaust system. Again, a stop arrangement is conventionally incorporated in the exhaust system to be engaged by the damper blade to maintain the damper blade in its position until the motor is once again energized.

Employment of the aforementioned spring return feature when there is a direct or positive interconnection between the motor and the damper blade causes difficulties. The spring return tends to over stress the motor when the blade hits the stop at normal condition. It has been found that the motor will "bounce" back and forth due to the inertia developed in the motor by the spring return. While the motor and damper blade eventually come to rest, the bounce action, especially over a period of time and frequent occurrence, causes considerable and undue wear of the motor's transmission gears, thereby shortening the life of the motor.

The present invention is directed to overcoming one or more of the problems set forth above.

DISCLOSURE OF THE INVENTION

The present invention is directed toward an apparatus and method of restricting flow of exhaust gas in an exhaust gas duct of a machine having an internal combustion engine. The apparatus includes a closure member pivotably mounted relative to the exhaust gas duct within the exhaust gas duct interior. The closure member is pivotable between a first position wherein fluid flow communication between an inlet and an outlet of the exhaust gas duct is substantially unblocked by the closure member and a second position wherein fluid flow communication between the inlet and the outlet is substantially blocked by the closure member. An actuator is operatively connected to the closure member, the actuator moving the closure member between the first position and the second position. A vehicle speed sensor and a throttle position sensor are provided, as is a manually operable switch moveable between an enable state and a disable state. An electronic controller is connected to the machine speed sensor, the throttle position sensor, the manually operable switch, and the actuator, wherein the electronic controller operates the actuator in response to a sensed value of the machine speed sensor, the throttle position sensor, and the state of the manually operable switch.

BRIEF DESCRIPTION OF THE DRAWINGS

For a better understanding of the present invention, reference may be made to the accompanying drawings, in which.

DESCRIPTION OF A PREFERRED EMBODIMENT OF THE INVENTION

Figure 1:
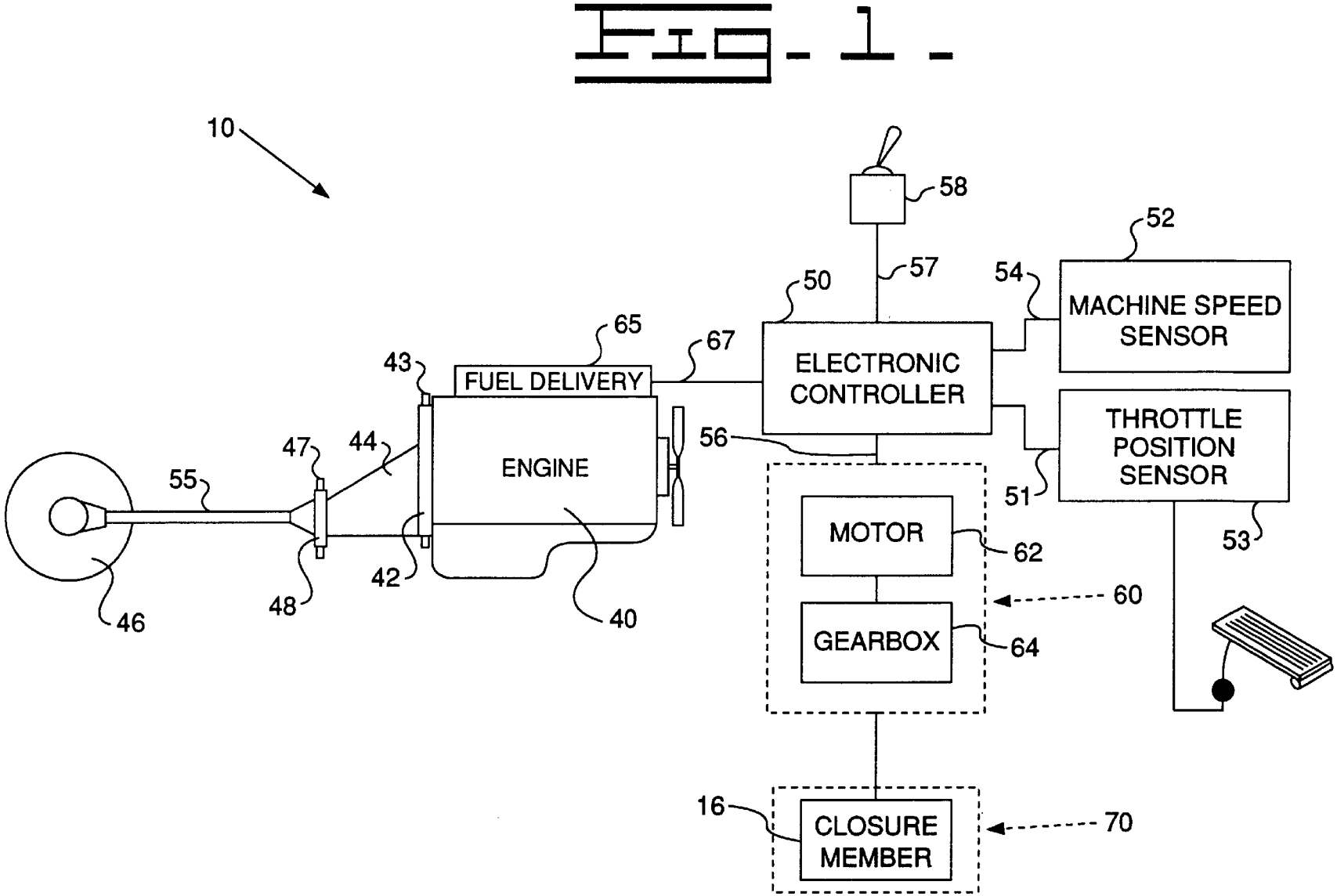
FIG. 1 is a block diagram of a preferred embodiment of the exhaust restrictor of the present invention.

Referring now to the drawings, an apparatus for restricting flow of exhaust in an exhaust gas duct is shown generally at 10. Referring now to FIG. 1, a preferred embodiment of the exhaust restrictor 10 is shown in block diagram form. The exhaust restrictor 10 is used in connection with an internal combustion engine 40. Associated with the engine 40 is a flywheel 42 rotatably connected to a transmission 44 to transmit power from the engine 40 to a drive wheel 46 of the machine. The transmission 42 is also connected to a second flywheel 48. The second flywheel 48 transmits power to a rotatable driveshaft 55 which, in connection with other gearing (not shown) causes the drivewheel 46 of the machine to turn, thereby propelling the machine.

The exhaust restrictor 10 includes an electronic controller 50, which is electrically connected to a machine speed sensor 52 via electrical connector 54, to a throttle position sensor 53 via electrical connector 51, to an actuator 60 via electrical connector 56, and to a manually operable mode selection switch 58 via electrical connector 57.

In the preferred embodiment, the machine speed is determined as follows. The second flywheel 48 rotates at a speed that is a function of the speed of the rotating driveshaft 55. The second flywheel 48 preferably includes teeth 47 or other features such as slots that are capable of being sensed when the second flywheel 48 rotates. A machine speed sensor 52 is located proximate to the second flywheel 48 such that the machine speed sensor 52 can sense the passing of the teeth 47 or other features as the flywheel 48 rotates. The machine speed sensor 52 produces a machine speed signal that is a function of the rotational velocity of the second flywheel 48, which in turn is a function of the speed of the driveshaft and the machine. The electronic controller 50 receives the machine speed signal over electrical connector 54.

The exhaust restrictor mode selection switch 58 preferably comprises a two position toggle switch that is biased to a first position. An operator can toggle switch 58 to the second position. The toggle switch produces a toggle switch or command signal indicative of the switch 58 being in either an enable state or a disable state. The electronic controller 50 receives the command signal over electrical connector 57. Although a preferred embodiment is described as including a toggle switch 58, it will be appreciated by those skilled in the art that other suitable switches can be readily and easily used without deviating from the spirit and scope of the present invention. For example, one skilled in the art would recognize that a push button switch, or other suitable momentary switch, could be substituted for the toggle switch.

As is known in the art, the electronic controller 50 produces a fuel delivery command signal that is delivered to the fuel delivery means 65. In a preferred embodiment of the present invention, the electronic controller issues the fuel delivery commend over an electrical connector 67. The fuel delivery command determines the quantity of fuel that will be delivered to the individual engine cylinders and therefore, in part, determines the rotational velocity of the engine. In a preferred embodiment, the fuel delivery means includes a plurality of electronically controlled fuel injectors (not shown). However, the present invention is not limited to engines having fuel injectors and includes other fuel delivery systems.

Figure 2:
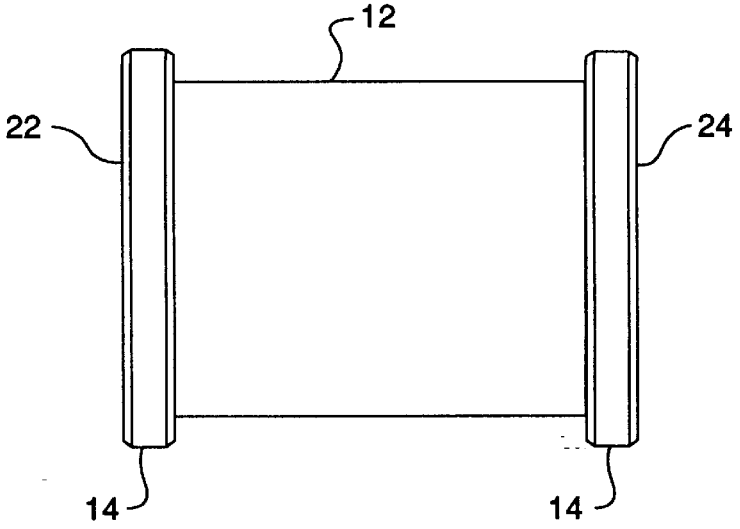
FIG. 2 is a side view of the conduit that is mounted to the exhaust gas duct.
Figure 3:
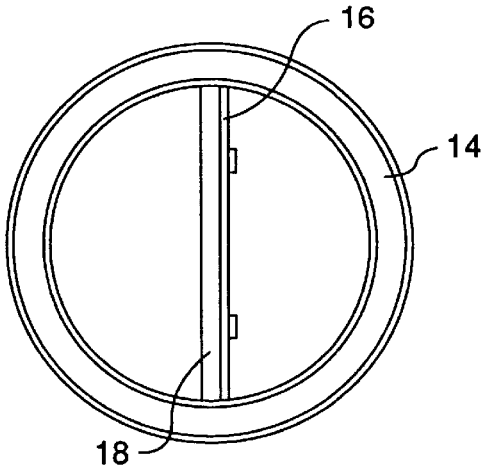
FIG. 3 is an end view of the conduit of FIG. 2 from the inlet side with the closure member open, and illustrating the closure member pivoting about an axis displaced a predetermined distance from the diametric axis.
Figure 4:
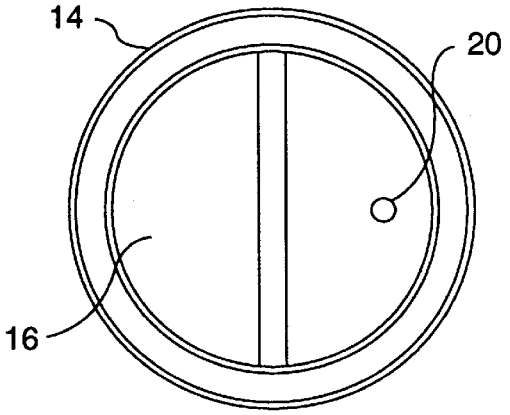
FIG. 4 is an end view of the conduit of FIG. 2 from the inlet side with the closure member closed, and illustrating the closure member arranged to pivot about a diametric axis.

Referring to FIGS. 2–4, the apparatus 10 includes a conduit 12 for connection by end flanges 14 to an exhaust gas duct or to an exhaust tract. The conduit 12 includes an inlet 22, an outlet 24, and an interior between the inlet 22 and the outlet 24, within which a closure member 16 is mounted upon an operating shaft 18. In the preferred embodiment, closure member 16 is a butterfly-type valve. However, it will be appreciated by those skilled in the art that other suitable closure members can be readily and easily used without deviating from the spirit and scope of the present invention.

The operating shaft 18 supports the closure member 16, and is pivotally mounted relative to the conduit 12 within the conduit interior. The closure member 16 is pivotal about an operating shaft pivot axis between a first position wherein fluid flow communication between the inlet 22 and the outlet 24 is substantially unblocked by the closure member 16 and a second position wherein fluid flow communication between the inlet 22 and the outlet 24 is substantially blocked by the closure member 16. The closure member 16 includes a bleed hole or aperture 20 therein. The aperture 20 permits a throughput of exhaust gas, thereby preventing back pressure being generated above prescribed levels if the closure member is closed when the engine RPM, and thus the exhaust flow, is large enough to generate excessive back pressure. It will be appreciated by those skilled in the art that the closure member 16 can be arranged to pivot about a diametric axis, in which case it is balanced with respect to the exhaust gas pressure acting on it when it is closed, or, as seen in FIG. 3, about an axis offset from a diameter of the conduit body so that the exhaust gas pressure will tend to open the valve. This pressure is at a maximum when the closure member 16 is fully closed, and falls off as the closure member 16 is opened, reaching a minimum value when the closure member 16 is fully opened.

Figure 5:
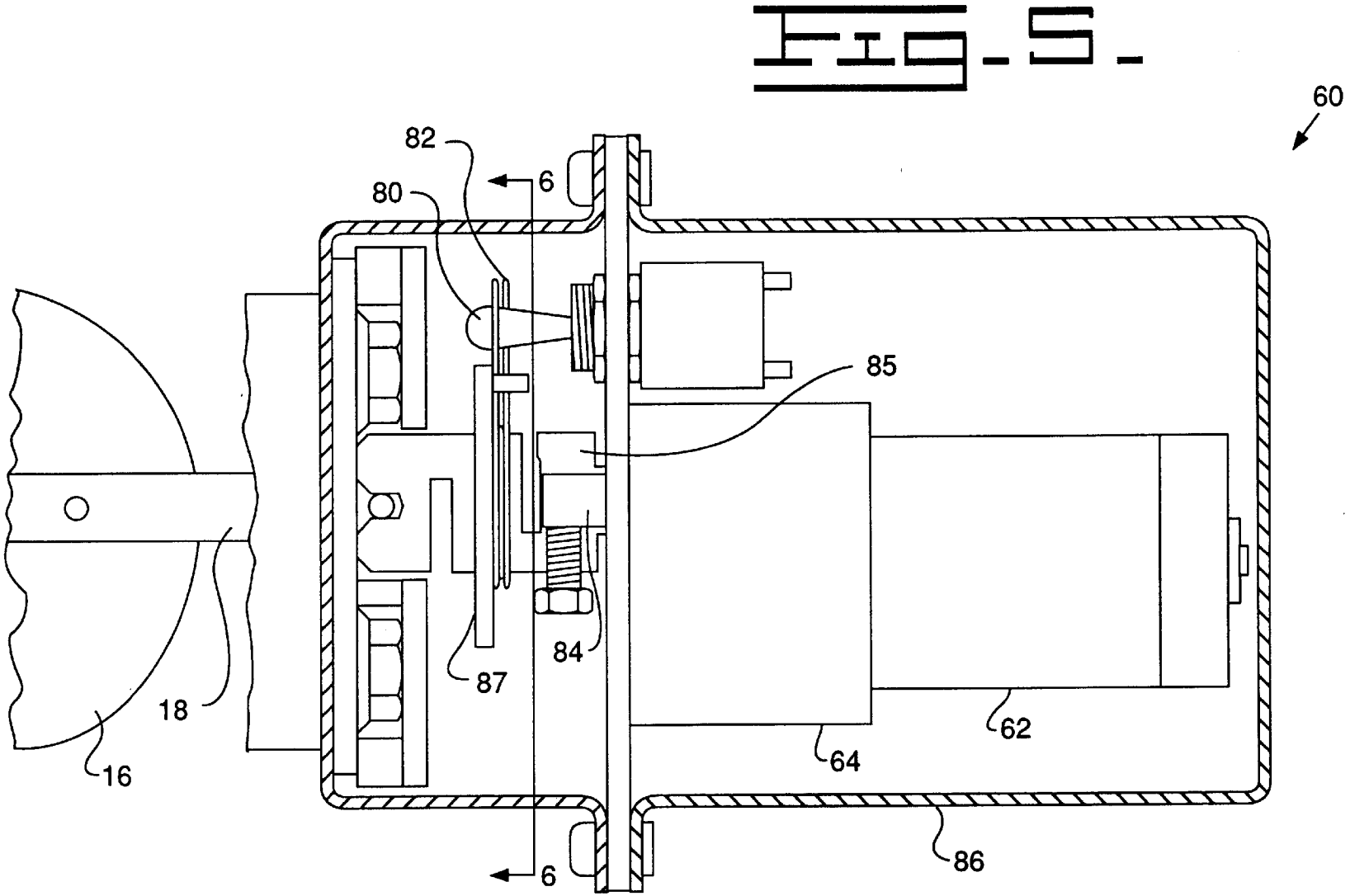
FIG. 5 is a diagrammatic view of the preferred embodiment of the actuator of the present invention.
Figure 6:
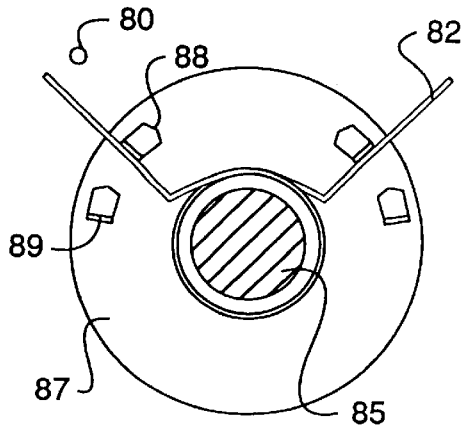
FIG. 6 is a sectional view taken along line 6—6 of FIG. 5.

Referring now to FIGS. 5 and 6, the actuator assembly 60 is contained within a housing 86, and includes a motor 62 connected to a gearbox 64. In the preferred embodiment, motor 62 is a DC motor capable of operating in a "forward" mode and a "reverse" mode. The operating shaft 18 is driven clockwise and counterclockwise by the motor 62 and gearbox 64. A unique switching arrangement configuration provides for stopping of the motor 62, polarity reversing, and spring biasing of the gear train to prevent wear, and is hereinafter described.

A compliant member 82 is connected to the output 84 of the gear box 64 via coupling 85. A spring retention member 87 is connected to coupling 85. Spring retention member 87 has a plurality of apertures 88 therein and tabs 89 are bent up to form stops for preloading compliant member 82. In the preferred embodiment, compliant member 82 is a leaf spring or a torsion spring. However, any spring-like device is contemplated for compliant member 82. A toggle switch 80 is connected to the motor 62 and to the compliant member 82. The toggle switch 80 is activated by the compliant member 82 as described below. In the preferred embodiment, toggle switch 80 is a double pole, double throw switch. Although a preferred embodiment is described as including a toggle switch 80, it will be appreciated by those skilled in the art that other suitable switches can be readily and easily used without deviating from the spirit and scope of the present invention.

The operation of actuator assembly 60 in the preferred embodiment is as follows. Referring to FIGS. 1, 5 and 6, power is applied to motor 62 from an output of controller 50. To rotate closure member 16, motor 62 turns the gear box 64, which causes the gear box output 84 to turn approximately ninety degrees, thereby causing operating shaft 18 to rotate, thereby causing the closure member 16 to rotate. As the gear box output 84 is rotating, coupling 85 and spring retention member 87 rotate, thereby causing compliant member 82 to "wind-up" and store energy until it "deflects", releasing the stored energy, thereby triggering toggle switch 80, and thereby causing power to the motor 62 to be disconnected. The motor 62 continues to stay in that position until the operator wishes to rotate the closure member 16, at which time the operator either activates switch 58, or depresses the vehicle's throttle pedal if wishing to rotate closure member from the closed position to the open position, thereby supplying power to the motor 62. The direction of current through the DC motor 62 is reversed, and the motor 62 then runs in the opposite direction, turning the gear box 64, which causes the gear box output 84 to turn back approximately ninety degrees, thereby causing operating shaft 18 to rotate in the opposite direction, thereby causing the closure member 16 to rotate in the opposite direction. As the gear box output 84 is rotating, compliant member 82 winds-up and deflects as described above, thereby triggering toggle switch 80, and thereby causing power to the motor 62 to once again be disconnected.

Figure 7:
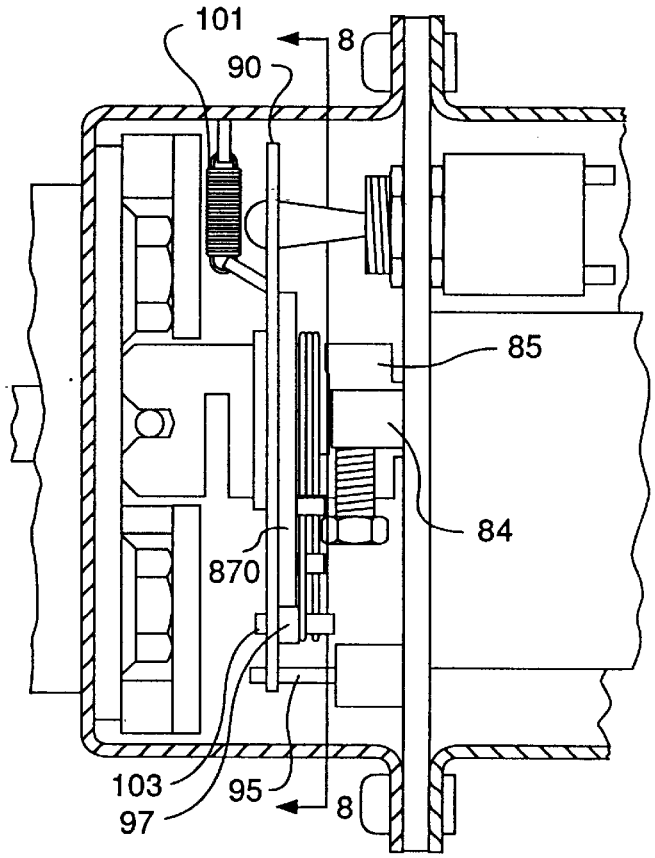
FIG. 7 is a diagrammatic view of an alternate embodiment of the actuator of the present invention.
Figure 8:
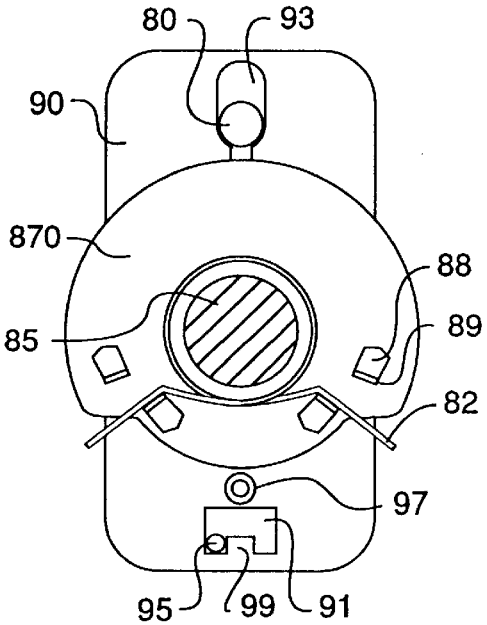
FIG. 8 is a sectional view taken along line 8—8 of FIG. 7.

Referring now to FIGS. 7 and 8, an alternate embodiment of the actuator assembly is shown, wherein a switch plate 90 is used in conjunction with compliant member 82 to trigger toggle switch 80. As described above, compliant member 82 is connected to the output 84 of the gear box via coupling 85. A spring retention member 870 is connected to coupling 85. Spring retention member 870, which preferably is in the form of a cam, has a plurality of apertures 88 therein and tabs 89 are bent up to form stops for preloading compliant member 82.

A roller 97 is mounted on the switch plate 90 and rolls on the edge of cam 870. A central aperture (not shown) is disposed in switch plate 90 and is slotted to allow the switch plate 90 to shift back and forth with respect to coupling 85. An extension spring 101 is connected to switch plate 90 and keeps switch plate 90 biased so that roller 97 rides against the cam 870 and stays in contact with the cam profile. A substantially U-shaped cutout 91 is disposed in switch plate 90. Disposed within cutout 91 is a pin 95 which is connected to a mounting base and protrudes up through the cutout 91. A switch slot 93 is disposed in switch plate 90 and within that slot is switch 82. As cam 870 rotates (clockwise), the compliant member 82 contacts the pin 103 that is protruding through roller 97. As pin 103 contacts compliant member 82, cam 870 causes the compliant member 82 to wind-up, increasing the tension on compliant member 82.

As seen in FIG. 8, cam 870 has a ramp on it so that roller 97 is required to ride up on the ramp, which shifts switch plate 90 "to the left". As switch plate 90 shifts to the left, pin 95 travels around trip mechanism 99, thereby allowing the force presented to switch plate 90 through pin 103 to "flip" the switch plate 90 to its second position, wherein pin 95 will end up in the lower corner of cutout 91. When switch plate 90 flips, it will transition the switch 80 to its other position. The above is reversed in order to transition switch 80 back to its original position.

Figure 9:
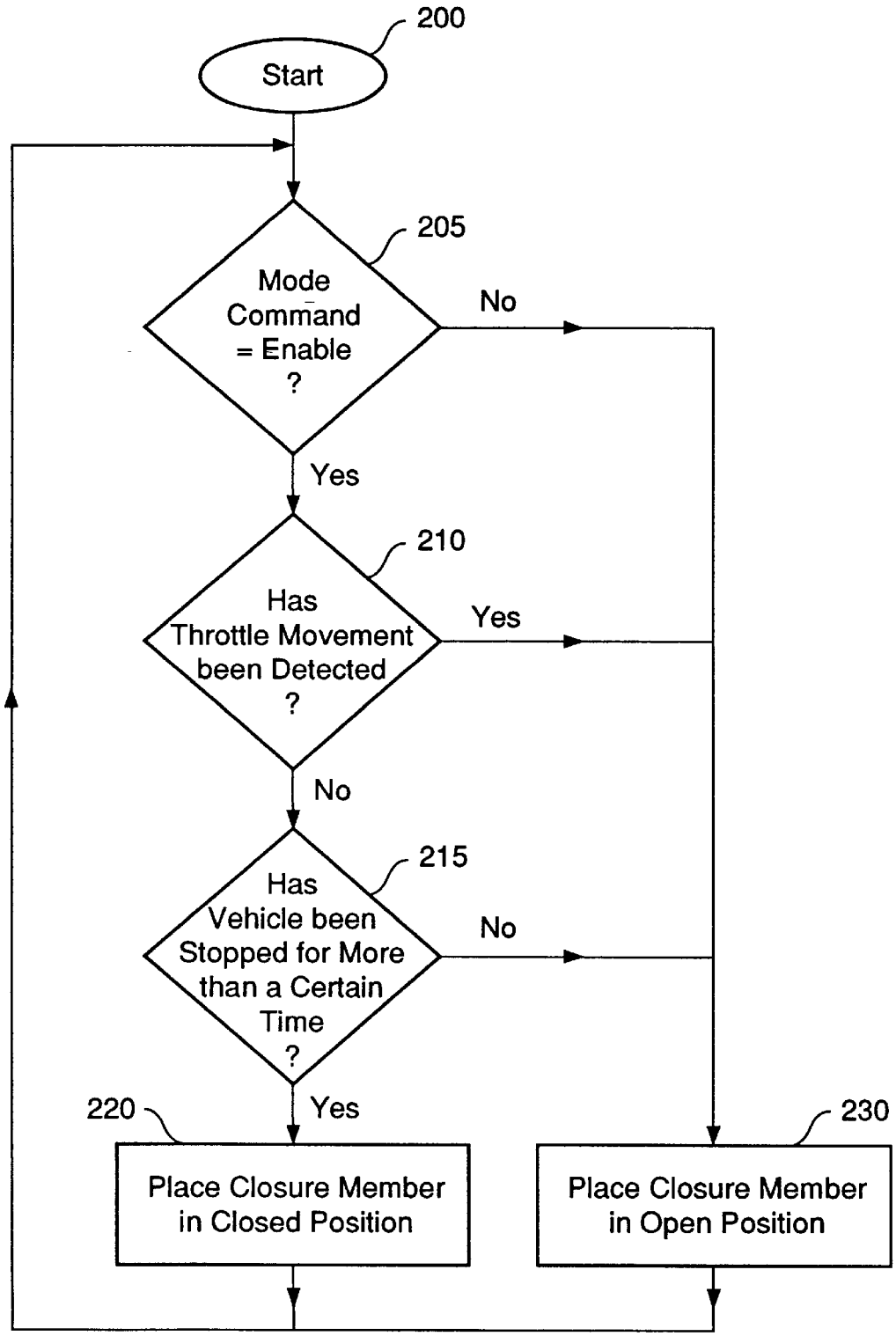
FIG. 9 is a flowchart of a preferred embodiment of the software control implemented in an electronic controller of the present invention.

Referring now to FIG. 9, a flowchart of the software control implemented in a preferred embodiment of the present invention is disclosed. The software necessary to perform the functions detailed in the flowchart can be readily and easily written by one skilled in the art using the instruction set for the specific microprocessor or electronic controller used in connection with the present invention.

Block 200 starts the software control implemented in a preferred embodiment of the invention. Software control passes to block 205. In block 205, the electronic controller 50 monitors the electrical connector 57 to determine whether a mode command signal from the toggle switch 58 is present. The toggle switch 58 produces a signal when the operator moves the switch to either a mode enable state or to a mode disable state. If the electronic controller 50 determines that the switch 58 is in the mode enable state, then control passes to block 210. Otherwise, control passes to block 230, wherein the closure member 16 is placed in the open (e.g. unrestricted gas flow) position.

If the condition of block 205 is satisfied, then the software control passes to block 210. In block 210, the electronic controller 50 receives the throttle position signal produced by the throttle position sensor 53 on electrical connector 51. If throttle movement has not been detected, then software control passes to block 215. Otherwise, control passes to block 230, wherein the closure member 16 is placed in the open (e.g. unrestricted gas flow) position.

If the condition of block 210 is satisfied, then the software control passes to block 215. In block 215, the electronic controller 50 receives the vehicle speed signal produced by the vehicle speed sensor 52 on electrical connector 54. If the vehicle speed is equal to zero for a predetermined period of time, then software control passes to block 220, wherein the closure member 16 is placed in the closed (e.g. restricted gas flow) position. Otherwise, control passes to block 230, wherein the closure member 16 is placed in the open (e.g. unrestricted gas flow) position. From blocks 220 and 230, program control returns to block 205.

Thus, while the present invention has been particularly shown and described with reference to the preferred embodiment above, it will be understood by those skilled in the art that various additional embodiments may be contemplated without departing from the spirit and scope of the present invention.

What is claimed is:

1. An apparatus for restricting flow of exhaust in an exhaust tract of a machine having an internal combustion engine, comprising:

a conduit having an inlet, an outlet, and an interior between said inlet and said outlet;

a closure member;

an operating shaft connected to said closure member, said operating shaft supporting said closure member and pivotally mounted relative to said conduit within said interior, said closure member being pivotal about an operating shaft pivot axis between a first position wherein fluid flow communication between said inlet and said outlet is substantially unblocked by said closure member and a second position wherein fluid flow communication between said inlet and said outlet is substantially blocked by said closure member;

an actuator assembly operatively connected to said closure member, said actuator assembly moving said closure member between said first position and said second position;

a machine speed sensor, said machine speed sensor producing a signal indicative of machine speed;

a throttle position sensor, said throttle position sensor producing a signal indicative of throttle position;

a manually operable switch moveable between an enable state and a disable state, said manually operable switch producing a command signal indicative of the state of the manually operable switch; and an electronic controller connected to said machine speed sensor, said throttle position sensor, said manually operable switch, and said actuator, said electronic controller receiving said machine speed signal, said throttle position signal, and said command signal and responsively producing an actuator control signal.

2. An apparatus as recited in claim 1, wherein said closure member includes an aperture therein, said aperture permitting a throughput of exhaust gas.

3. An apparatus as recited in claim 2, wherein said actuator comprises a motor operatively connected to a gear box.

4. An apparatus as recited in claim 3, including a compliant member connected to an output of said gear box.

5. An apparatus as recited in claim 4, wherein said motor operates in a forward mode and in a reverse mode.

6. An apparatus as recited in claim 5, including a toggle switch connected to said compliant member, said toggle switch being actuated by said compliant member, said toggle switch disconnecting power from said motor when said toggle switch is actuated.

7. An apparatus as recited in claim 6, including a compliant member retention member, said compliant member retention member connected to said compliant member and to the output of said gear box.

8. An apparatus as recited in claim 7, wherein said compliant member retention member includes a plurality of tabs thereon for preloading said compliant member.

9. An apparatus as recited in claim 8, wherein said compliant member retention member is a cam.

10. An apparatus as recited in claim 9, including a switch plate pivotally connected to said compliant member retention member, said switch plate having a toggle switch aperture disposed therein, said toggle switch protruding through said toggle switch aperture, whereby when said switch plate pivots said toggle switch is actuated.

11. An apparatus as recited in claim 1, wherein said closure member is a butterfly.

12. An apparatus as recited in claim 4, wherein said compliant member is a torsion spring.

13. An apparatus as recited in claim 4, wherein said compliant member is a leaf spring.

14. An apparatus as recited in claim 2, wherein said operating shaft pivot axis is offset from an axis of symmetry of said interior, such that a resultant torque generated in response to increasing pressure at said inlet tends to open said closure member.

15. A method of restricting flow of exhaust in an exhaust tract of a machine having an internal combustion engine, comprising the steps of:

providing a closure member operatively connected to an actuator and pivotably mounted relative to the exhaust gas duct within an interior of the exhaust gas duct;

sensing machine speed and producing a machine speed signal in response thereto;

sensing throttle position and producing a throttle position signal in response thereto;

sensing actuation of a manually operable switch and producing a command signal in response thereto; and receiving the machine speed signal, the throttle position signal, and the command signal and responsively producing an actuator control signal.

16. A method as recited in claim 15, including the step of disconnecting power to said actuator in response to said machine speed signal being outside a predetermined range.

17. A method as recited in claim 15, including the step of disconnecting power to said actuator in response to said throttle position signal being outside a predetermined range.

18. A method as recited in claim 15, including the step of disconnecting power to said actuator in response to said command signal indicating an off state.

* * * * *